US010316803B2

(12) United States Patent
Hampson et al.

(10) Patent No.: US 10,316,803 B2
(45) Date of Patent: Jun. 11, 2019

(54) PASSIVE PUMPING FOR RECIRCULATING EXHAUST GAS

(71) Applicant: Woodward, Inc., Fort Collins, CO (US)

(72) Inventors: Gregory James Hampson, Boulder, CO (US); Domenico Chiera, Fort Collins, CO (US)

(73) Assignee: Woodward, Inc., Fort Collins, CO (US)

( * ) Notice: Subject to any disclaimer, the term of this patent is extended or adjusted under 35 U.S.C. 154(b) by 0 days.

(21) Appl. No.: 15/714,699

(22) Filed: Sep. 25, 2017

(65) Prior Publication Data

US 2019/0093604 A1 Mar. 28, 2019

(51) Int. Cl.

| | |
|---|---|
| ***F02M 26/19*** | (2016.01) |
| ***F02M 35/10*** | (2006.01) |
| ***F02D 9/02*** | (2006.01) |
| ***F02M 21/04*** | (2006.01) |
| ***F02M 26/10*** | (2016.01) |

(52) U.S. Cl.

CPC ..... *F02M 26/19* (2016.02); *F02D 9/02* (2013.01); *F02M 21/047* (2013.01); *F02M 26/10* (2016.02); *F02M 35/10222* (2013.01)

(58) Field of Classification Search

CPC ..... F02M 26/02; F02M 26/03; F02M 26/04; F02M 26/05; F02M 26/09; F02M 26/10; F02M 26/17; F02M 26/19; F02M 26/22; F02M 35/10222; F02M 35/10006; F02M 35/10242; F02M 35/10262; F02M 35/10118

See application file for complete search history.

(56) References Cited

U.S. PATENT DOCUMENTS

| | | | |
|---|---|---|---|
| 4,069,797 | A | 1/1978 | Nohira et al. |
| 4,183,333 | A | 1/1980 | Aoyama |
| 4,203,400 | A | 5/1980 | Yorioka |

(Continued)

FOREIGN PATENT DOCUMENTS

| | | |
|---|---|---|
| CN | 202125377 | 1/2012 |
| CN | 103306858 | 9/2013 |

(Continued)

OTHER PUBLICATIONS

Machine translation. JP2002-221103A, Onodera et al., publ'n date Aug. 9, 2002, obtained from https://worldwide.espacenet.com/, pp. 1-11.*

(Continued)

*Primary Examiner* — Grant Moubry
(74) *Attorney, Agent, or Firm* — Fish & Richardson P.C.

(57) ABSTRACT

An exhaust gas recirculation mixer includes a convergent nozzle in a flow path from an air inlet of the mixer to an outlet of the mixer. The convergent nozzle is oriented converging toward the outlet of the mixer. The nozzle accelerates the flow to high velocity, which is released as a free-jet. The mixer includes an exhaust gas housing having an exhaust gas inlet into an interior of the exhaust gas housing, and a convergent-divergent nozzle having an air-fuel-exhaust gas inlet in fluid communication to receive fluid flow from the convergent nozzle (i.e., the free-jet), the interior of the exhaust gas housing, and a fuel supply into the mixer.

12 Claims, 2 Drawing Sheets

(56) References Cited

U.S. PATENT DOCUMENTS

| | | | | |
|---|---|---|---|---|
| 4,249,503 | A | 2/1981 | Noguchi et al. | |
| 4,271,795 | A | 6/1981 | Nakagawa et al. | |
| 5,611,203 | A | 3/1997 | Henderson et al. | |
| 5,611,204 | A | 3/1997 | Radovanovic et al. | |
| 5,974,802 | A | 11/1999 | Blake | |
| 6,003,316 | A | 12/1999 | Baert et al. | |
| 6,216,458 | B1 | 4/2001 | Alger et al. | |
| 6,267,106 | B1 | 7/2001 | Feucht | |
| 6,343,594 | B1 | 2/2002 | Koeslin et al. | |
| 6,408,833 | B1 | 6/2002 | Faletti | |
| 6,425,382 | B1 | 7/2002 | Marthaler et al. | |
| 6,470,864 | B2 | 10/2002 | Kim et al. | |
| 6,609,373 | B2 | 8/2003 | Coleman et al. | |
| 6,609,374 | B2 | 8/2003 | Feucht et al. | |
| 6,659,092 | B2 | 12/2003 | Coleman et al. | |
| 6,729,133 | B1 | 5/2004 | Sorter et al. | |
| 6,732,524 | B2 | 5/2004 | Sponton | |
| 6,776,146 | B1 | 8/2004 | Ricart-Ugaz et al. | |
| 6,810,725 | B2 | 11/2004 | Henderson et al. | |
| 6,880,535 | B2 * | 4/2005 | Sorter | F02B 43/08 123/528 |
| 6,886,544 | B1 | 5/2005 | Bui | |
| 6,983,645 | B2 | 1/2006 | Webb et al. | |
| 7,032,578 | B2 | 4/2006 | Liu et al. | |
| 7,040,305 | B2 | 5/2006 | Sponton | |
| 7,140,874 | B2 | 11/2006 | Ingalls, Jr. et al. | |
| 7,175,422 | B2 | 2/2007 | Webb et al. | |
| 7,178,492 | B2 | 2/2007 | Coleman et al. | |
| 7,191,743 | B2 | 3/2007 | Weber et al. | |
| 7,212,926 | B2 | 5/2007 | Ingalls, Jr. et al. | |
| 7,243,495 | B2 * | 7/2007 | Whelan | F02B 29/0406 123/568.12 |
| 7,277,801 | B2 | 10/2007 | Webb et al. | |
| 7,281,530 | B2 | 10/2007 | Usei | |
| 7,299,137 | B2 | 11/2007 | Bartley et al. | |
| 7,311,090 | B2 | 12/2007 | Lyons | |
| 7,322,193 | B2 | 1/2008 | Bering et al. | |
| 7,347,086 | B2 | 3/2008 | Webb et al. | |
| 7,389,770 | B2 | 6/2008 | Bertilsson et al. | |
| 7,412,335 | B2 | 8/2008 | Anderson et al. | |
| 7,550,126 | B2 | 6/2009 | Webb et al. | |
| 7,578,179 | B2 | 8/2009 | Krueger et al. | |
| 7,597,016 | B2 | 10/2009 | Timmons et al. | |
| 7,669,411 | B2 | 3/2010 | Mallampalli et al. | |
| 7,712,314 | B1 * | 5/2010 | Barnes | F23R 3/002 60/755 |
| 7,748,976 | B2 | 7/2010 | Burrahm et al. | |
| 7,833,301 | B2 | 11/2010 | Schindler et al. | |
| 7,854,118 | B2 | 12/2010 | Vetrovec | |
| 7,934,492 | B2 | 5/2011 | Gerum | |
| 8,047,185 | B2 | 11/2011 | Ulrey et al. | |
| 8,056,340 | B2 | 11/2011 | Vaught et al. | |
| 8,061,120 | B2 | 11/2011 | Hwang | |
| 8,425,224 | B2 | 4/2013 | Webb et al. | |
| 8,821,349 | B2 | 9/2014 | Cunningham et al. | |
| 8,950,383 | B2 * | 2/2015 | Sperry | F02M 21/042 123/527 |
| 9,051,900 | B2 | 6/2015 | Regner | |
| 9,074,540 | B2 | 7/2015 | Subramanian | |
| 9,239,034 | B2 | 1/2016 | Cunningham et al. | |
| 9,303,557 | B2 | 4/2016 | Ulrey et al. | |
| 9,309,837 | B2 | 4/2016 | Ulrey et al. | |
| 9,448,091 | B2 | 9/2016 | Woodsend | |
| 9,488,098 | B2 | 11/2016 | Sponsky | |
| 9,546,591 | B2 | 1/2017 | Ge | |
| 9,651,004 | B2 | 5/2017 | Zhang | |
| 9,879,640 | B2 * | 1/2018 | Dahl | F02M 26/12 |
| 2004/0173192 | A1 * | 9/2004 | Sorter | F02B 43/08 123/528 |
| 2005/0247284 | A1 | 11/2005 | Weber et al. | |
| 2006/0021346 | A1 | 2/2006 | Whelan et al. | |
| 2006/0168958 | A1 | 8/2006 | Vetrovec | |
| 2007/0039321 | A1 | 2/2007 | Sheidler | |
| 2012/0180478 | A1 | 7/2012 | Johnson et al. | |
| 2013/0042611 | A1 * | 2/2013 | Kaneko | F02D 13/02 60/605.2 |
| 2013/0319381 | A1 | 12/2013 | Piaz | |
| 2014/0238364 | A1 | 8/2014 | Beyer et al. | |
| 2015/0047317 | A1 | 2/2015 | Ulrey et al. | |
| 2015/0047618 | A1 | 2/2015 | Ulrey et al. | |
| 2015/0083085 | A1 * | 3/2015 | Ravenhill | F02D 7/002 123/48 R |
| 2015/0267650 | A1 | 9/2015 | Siuchta et al. | |
| 2015/0369126 | A1 | 12/2015 | Knopfel et al. | |
| 2016/0281650 | A1 * | 9/2016 | Roth | F02M 26/19 |
| 2016/0319778 | A1 | 11/2016 | Shuto et al. | |
| 2017/0022941 | A1 | 1/2017 | Mallard | |
| 2017/0030305 | A1 | 2/2017 | Sugiyama | |
| 2017/0306899 | A1 * | 10/2017 | Sanami | F02M 26/34 |

FOREIGN PATENT DOCUMENTS

| | | | | |
|---|---|---|---|---|
| CN | 103397959 | | 11/2013 | |
| CN | 203335295 | | 12/2013 | |
| CN | 203499859 | | 3/2014 | |
| CN | 204386776 | | 6/2015 | |
| DE | 181618 | | 3/1907 | |
| DE | 19587578 | | 6/1999 | |
| EP | 0653559 | | 5/1995 | |
| EP | 0732490 | | 9/1996 | |
| EP | 1020632 | B1 | 6/2004 | |
| EP | 1859128 | B1 | 7/2008 | |
| EP | 2562397 | | 2/2013 | |
| FR | 2902466 | | 12/2007 | |
| FR | 2893988 | B1 | 1/2008 | |
| GB | 2313623 | | 12/1997 | |
| GB | 2438360 | | 11/2007 | |
| JP | H 09195860 | | 7/1997 | |
| JP | H 10131742 | | 5/1998 | |
| JP | H 11324812 | | 11/1999 | |
| JP | 2000097111 | | 4/2000 | |
| JP | 2000230460 | | 8/2000 | |
| JP | 2002221103 | | 8/2002 | |
| JP | 2004100508 | | 4/2004 | |
| JP | 2005147010 | | 6/2005 | |
| JP | 2005147011 | | 6/2005 | |
| JP | 2005147030 | | 6/2005 | |
| JP | 2005147049 | | 6/2005 | |
| JP | 2006132373 | | 5/2006 | |
| JP | 2007092592 | | 4/2007 | |
| JP | 2009299591 | | 12/2009 | |
| JP | 2010101191 | | 5/2010 | |
| JP | 2010261363 | A * | 11/2010 | F02D 21/08 |
| JP | 2013087720 | | 5/2013 | |
| JP | 2013113097 | | 6/2013 | |
| JP | 2013170539 | | 9/2013 | |
| JP | 5530267 | | 6/2014 | |
| JP | 5916335 | | 5/2016 | |
| JP | 5935975 | | 6/2016 | |
| JP | 5938974 | | 6/2016 | |
| JP | 6035987 | | 11/2016 | |
| JP | 6051881 | | 12/2016 | |

OTHER PUBLICATIONS

Machine translation. JP2010261363A, Kashiwakura, publ'n date Oct. 26, 2012, obtained from https://worldwide.espacenet.com/, pp. 1-10.*

International Search Report and Written Opinion in International Application No. PCT/US2018/052637, dated Dec. 21, 2018, 14 pages.

Office Action issued in Chinese Application No. 201721556484.3 dated May 14, 2018; 3 pages.

* cited by examiner

PASSIVE PUMPING FOR RECIRCULATING EXHAUST GAS

TECHNICAL FIELD

This disclosure relates to exhaust recirculation (EGR) systems for internal combustion engines.

BACKGROUND

Exhaust gas recirculation, especially cooled EGR, can be added to internal combustion engine systems to reduce NOx emissions and reduce knock tendency. In such a system, an amount of exhaust gas is added to the air and/or fuel mixture within the air-intake manifold of the engine. The challenge is that there is a cost to deliver the cooled EGR (cEGR), especially for high efficiency engines which generally are most efficient when the exhaust manifold pressure is lower than the intake manifold pressure. The pressure difference creates a positive scavenging pressure difference across the engine which scavenges burn gas from the cylinder well and provides favorable pressure-volume pumping loop work. It is particularly challenging to deliver cEGR from its source at the exhaust manifold to the intake manifold without negatively impacting the residual gas scavenging and efficiency of the engine cycle via the pumping loop. The "classic" high pressure loop cEGR system plumbs the exhaust gas directly to the intake manifold, which requires either design or variable turbocharging to force the engine exhaust manifold pressure to be higher than the intake manifold, which in turn, unfavorably reduces scavenging of hot burned gases and engine P-V cycle and loses efficiency. It is particularly counterproductive since the purpose of the cEGR is to reduce the knock tendency to improve efficiency and power density. But, this classic method to drive EGR actually increases the knock tendency through residual gas retention and reduces efficiency thru negative pressure work on the engine—in a manner of diminishing returns, i.e., two steps forward to reduce knock with cEGR, but one step back due to how it is pumped, leading to a zero gain point where the cost of driving cEGR counteracts the benefits of delivering it.

SUMMARY

This disclosure describes technologies relating to recirculating exhaust gas.

An example implementation of the subject matter described within this disclosure is an exhaust gas recirculation mixer with the following features. A convergent nozzle is in a flow path from an air inlet of the mixer to an outlet of the mixer. The convergent nozzle converges toward the outlet of the mixer. An exhaust gas housing includes an exhaust gas inlet into an interior of the exhaust gas housing. A convergent-divergent nozzle includes an air-exhaust gas inlet in fluid communication to receive fluid flow from the convergent nozzle, the interior of the exhaust gas housing.

Aspects of the example implementation, which can be combined with the example implementation alone or in combination, include the following. The air-exhaust gas inlet of the convergent-divergent nozzle is an air-fuel-exhaust gas inlet in communication with a fuel supply into the mixer.

Aspects of the example implementation, which can be combined with the example implementation alone or in combination, include the following. A fuel supply tube is positioned parallel and centrally within the air flow path.

The fuel supply tube is configured to supply fuel into the air flow path in a direction of flow and upstream of the convergent nozzle.

Aspects of the example implementation, which can be combined with the example implementation alone or in combination, include the following. The fuel supply tube includes a gaseous fuel supply tube.

Aspects of the example implementation, which can be combined with the example implementation alone or in combination, include the following. The fuel supply includes a fuel supply port upstream of the exhaust gas inlet.

Aspects of the example implementation, which can be combined with the example implementation alone or in combination, include the following. The fuel supply port includes a gaseous fuel supply port.

Aspects of the example implementation, which can be combined with the example implementation alone or in combination, include the following. The convergent nozzle and the convergent-divergent nozzle are aligned on a same center axis.

Aspects of the example implementation, which can be combined with the example implementation alone or in combination, include the following. The exhaust inlet is upstream of an outlet of the convergent nozzle.

Aspects of the example implementation, which can be combined with the example implementation alone or in combination, include the following. The convergent nozzle is at least partially within the exhaust gas housing.

Aspects of the example implementation, which can be combined with the example implementation alone or in combination, include the following. An inlet of the convergent-divergent nozzle has a greater area than an exit of the convergent nozzle.

An example implementation of the subject matter described within this disclosure is a method with the following features. a velocity of an air flow is increased and a pressure of the air flow is decreased with a convergent nozzle to form a free jet exiting the converging nozzle. An exhaust flow is introduced downstream of the convergent nozzle in response to the decreased pressure of the free jet air flow. The air flow and the exhaust flow are mixed to form a mixture with a second convergent nozzle downstream of the convergent nozzle. a pressure of the combustion mixture is increased and a velocity of the combustion mixture is reduced with a divergent nozzle.

Aspects of the example method, which can be combined with the example method alone or in combination, include the following. Mixing the air flow and exhaust flow to form a mixture includes mixing the air flow, the exhaust flow, and a fuel flow to form a combustion mixture.

Aspects of the example method, which can be combined with the example method alone or in combination, include the following. The fuel flow is supplied into the air flow with a fuel supply tube parallel and in line with a center of an air flow path. The fuel flow is supplied upstream of the convergent nozzle.

Aspects of the example method, which can be combined with the example method alone or in combination, include the following. The fuel flow is supplied into the exhaust flow with a fuel supply port.

Aspects of the example method, which can be combined with the example method alone or in combination, include the following. The fuel flow includes a gaseous fuel flow.

Aspects of the example method, which can be combined with the example method alone or in combination, include the following. The exhaust flow is directed from an exhaust manifold to a point downstream of the convergent nozzle.

Aspects of the example method, which can be combined with the example method alone or in combination, include the following. The fuel flow includes a gaseous fuel.

Aspects of the example method, which can be combined with the example method alone or in combination, include the following. The fuel flow has an injection velocity higher than an air flow velocity.

An example implementation of the subject matter described within this disclosure is an engine system with the following features. An intake manifold is configured to receive a combustible mixture configured to be combusted within a combustion chamber. A throttle is positioned upstream of the intake manifold. The throttle is configured to at least partially regulate an air flow into the intake manifold. An exhaust manifold is configured to receive combustion products from the combustion chamber. An exhaust gas recirculation mixer is downstream of a throttle and upstream of an intake manifold. The exhaust gas recirculation mixer includes a convergent nozzle in a flow path from an air inlet of the mixer to an outlet of the mixer. The convergent nozzle converges toward the outlet of the mixer. An exhaust gas housing includes an exhaust gas inlet into an interior of the exhaust gas housing. A convergent-divergent nozzle includes an air-fuel-exhaust gas inlet in fluid communication to receive fluid flow from the convergent nozzle, the interior of the exhaust gas housing, and a fuel supply into the mixer.

Aspects of the example system, which can be combined with the example system alone or in combination, include the following. A compressor is upstream of the throttle. The compressor is configured to increase a pressure within the air flow path.

Aspects of the example system, which can be combined with the example system alone or in combination, include the following. A turbine is downstream of the exhaust manifold. The turbine is coupled to the compressor and is configured to rotate the compressor.

Aspects of the example system, which can be combined with the example system alone or in combination, include the following. An exhaust gas cooler is positioned within a flow path between the exhaust manifold and the exhaust gas recirculation mixer. The exhaust gas cooler is configured to lower a temperature of the exhaust gas prior to the exhaust gas recirculation mixer.

Particular implementations of the subject matter described herein can have one or more of the following advantages. The exhaust gas recirculation mixer can allow recirculating exhaust gas into a pressurized engine intake, such as in a supercharged or turbocharged engine, when the exhaust gas source is at a lower pressure than the intake. In certain instances, the mixer can enable admission of exhaust gas even when the internal combustion engine is running under high-load and high boost. At such high-load high boost conditions, EGR is needed the most but it is also most difficult to supply the EGR, due to the higher pressure in the intake system over the exhaust. Moreover, the mixer can mitigate high back pressure in the exhaust system, which prevents burned gas from effectively leaving the combustion chamber and, itself, promotes knock. The mixer is a passive pump, relying on the area reduction of the primary gas stream to accelerate the gas to a high velocity. The accelerated gas causes a low pressure using the Bernouli's effect, followed by the creation of a free jet of the gas into a receiver chamber. The free jet generated low pressure acts as a suction in the receiver chamber, which when connected to the EGR path, manifests as a pressure below the exhaust manifold creating a favorable pressure gradient for the EGR to flow to the lower pressure to admit exhaust gas into the mixer. Following the mixer, the reverse Bernouli effect converts the high velocity gas mixture to a high pressure when it is decelerated into the engine intake manifold. Thus, it mitigates system efficiency losses attributable to the pumping work needed to operate more conventional EGR systems and the negative scavenging pressures across the engine. The mixer is also quite simple in construction, and needs no working parts to operate. The mixer can also be mechanically designed to have different primary flow nozzles which can be modular (e.g., threaded on/off the change out), interchangeably fitted for a wide range of engine displacement families. Further, the mixer creates internal turbulence that promotes mixing of the EGR, air and fuel. Further, the mixer can receive fuel, and operate to mix the fuel, air and EGR. Thus, some implementations 1) reduce the pressure difference across the engine to drive EGR from the exhaust manifold to the intake manifold—under any back pressure to intake pressure ratio, 2) including the special case when it is desirable to maintain the back pressure equal to or below the intake pressure—which (a) improves efficiency (due to the reduction of Pumping Mean Effective Pressure (PMEP) and (b) reduces the retention of hot burned gases trapped inside the combustion chamber which themselves increase the very knock tendency that the active cooled EGR is attempting to reduce, (3) the addition of high velocity fuel enhances the Jet and suction effect, (4) can simplify the fuel delivery system by eliminating the pressure regulator and pre-heater circuit since the mixer favors high pressure fuel and cold fuel to cool the EGR using the Joules-Thomson effect (fuel jetting will cause the temperature to drop—which is favorable since cooled EGR and cooled intake air are beneficial to engine operation).

The details of one or more implementations are set forth in the accompanying drawings and the description below. Other features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

Exhaust gas recirculation (EGR) can have parasitic effects on an engine system, that is, it can reduce the effective power output of an engine system as energy is required to move exhaust gas from an exhaust manifold and into an intake manifold. This is especially problematic on forced induction engines where the intake manifold pressure can be higher than the exhaust manifold pressure. Ironically, EGR is most needed when the intake manifold pressure is high, such as when the engine is running at high load. In the case of a turbo-charged engine, increased back-pressure within the exhaust manifold can also contribute to knock under high loads.

The concepts herein relate to an EGR system that can be used on an internal combustion engine, including a forced induction internal combustion engine. A jet pump is added to the air intake system of the engine between the throttle and the intake manifold. If a compressor is provided in the intake system, the jet pump can be placed downstream of the compressor (although it could alternatively be placed upstream of the compressor, too). Air, the primary fluid, is flowed through a central flow path of the jet pump from the throttle towards the intake manifold. In a low pressure receiver region within the jet pump, recirculated exhaust gas is added to the air stream from the exhaust manifold. The lower effective pressure in the receiver allows for a pressure differential to form between the exhaust manifold and the receiver. The reverse Bernoulli effect recovers the pressure by slowing down the high velocity/low pressure gas to create a pressure in the intake manifold that is equal to or higher than the exhaust manifold. So at the system level, the jet pump enables the exhaust gas to flow from the exhaust manifold to the intake manifold even when the exhaust manifold is at a lower pressure. Fuel can be added to the air stream upstream of the convergent end of a convergent nozzle. Turbulence is produced as the three streams combine within the jet pump leading to a well-mixed, combustible mixture flowing into the manifold.

Figure 1:
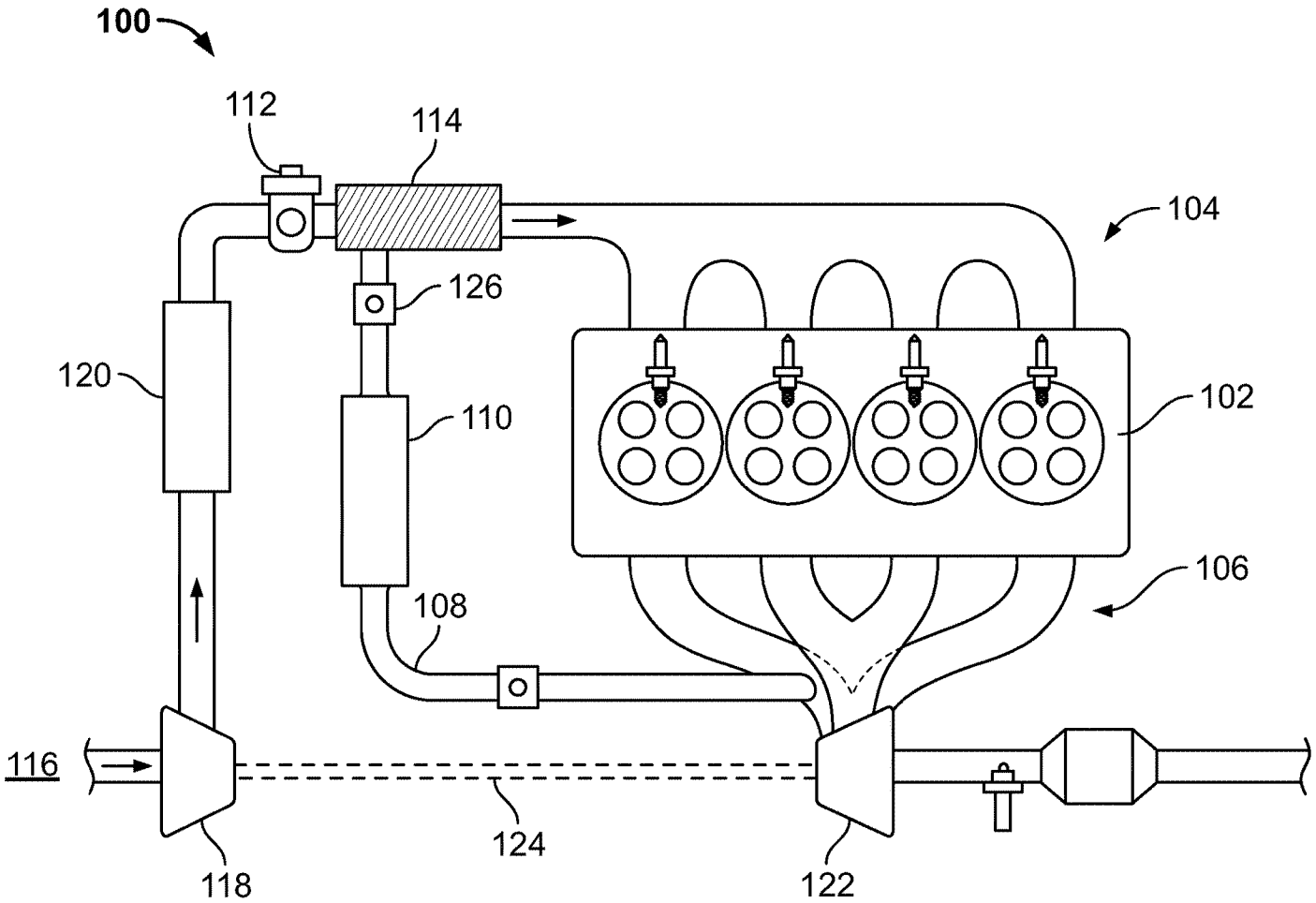
FIG. 1 is a schematic diagram of an example internal combustion engine system.

FIG. 1 shows an example engine system 100. The engine system 100 includes an intake manifold 104 configured to receive a combustible mixture to be combusted within a combustion chamber of the engine 102. That is, the intake manifold is fluidically coupled to a source of oxygen and a source of fuel. The combustible mixture can include air and any combustible fluid, such as natural gas, atomized gasoline, or diesel. While the illustrated implementation includes a four-cylinder engine 102, any number of cylinders can be used. Also, while the illustrated implementation includes a piston engine 102, aspects of this disclosure can be applied to other types of internal combustion engines, such as rotary engines or gas turbine engines.

A throttle 112 is positioned upstream of the intake manifold 104. The throttle 112 is configured to regulate an air flow into the intake manifold from the ambient environment 116, for example, by changing a cross-sectional area of a flow passage going through the throttle 112. In some implementations, the throttle 112 can include a butterfly valve or a disc valve. Reducing the cross-sectional area of the flow passage through the throttle 112 reduces the flowrate of air flowing through the throttle 112 towards the intake manifold 104.

An exhaust manifold 106 is configured to receive combustion products (exhaust) from a combustion chamber of the engine 102. That is, the exhaust manifold is fluidically coupled to an outlet of the combustion chamber. An EGR flow passage 108 or conduit fluidically connects the exhaust manifold 106 and the intake manifold 104. In the illustrated implementation, an EGR throttle valve 126 is located within the EGR flow passage 108 between the exhaust manifold 106 and the intake manifold 104 and is used to regulate the EGR flow. The EGR throttle valve 126 regulates the EGR flow by adjusting a cross-sectional area of the EGR flow passage 108 going through the EGR throttle valve 126. In some implementations, the EGR throttle valve 126 can include a butterfly valve, a disc valve, a needle valve, or another style of valve.

The EGR flow passage feeds into an EGR mixer 114 that is located downstream of a throttle 112 and upstream of the intake manifold 104 in the illustrated implementation. The EGR mixer 114 is in the engine intake system, fluidically connected to the throttle 112, the intake manifold 104, and the EGR flow passage 108. The fluid connections can be made with conduits containing flow passages that allow fluid flow. In some implementations, the EGR mixer 114 can be included within a conduit connecting the intake manifold 104 to the throttle 112, within the intake manifold 104 itself, within the EGR flow passage 108, integrated within the throttle 112, or integrated into the EGR throttle valve 126. Details about an example EGR mixer are described later within this disclosure.

In the illustrated implementation, an exhaust gas cooler 110 is positioned in the EGR flow passage 108 between the exhaust manifold 106 and the EGR mixer 114. The exhaust gas cooler can operate to lower a temperature of the exhaust gas prior to the EGR mixer. The exhaust gas cooler is a heat exchanger, such as an air-air exchanger or an air-water exchanger.

In some implementations, the engine system 100 includes a compressor 118 upstream of the throttle 112. In an engine with a compressor 118 but no throttle, such as an unthrottled diesel engine, the throttle is not needed and the mixer can be down stream of the compressor. The compressor 118 can include a centrifugal compressor, a positive displacement compressor, or another type of compressor for increasing a pressure within the air EGR flow passage 108 during engine operation. In some implementations, the engine system 100 can include an intercooler 120 that is configured to cool the compressed air prior to the air entering the manifold. In the illustrated implementation, the compressor 118 is a part of a turbocharger. That is, a turbine 122 is located downstream of the exhaust manifold 106 and rotates as the exhaust gas expands through the turbine 122. The turbine 122 is coupled to the compressor 118, for example, via a shaft and imparts rotation on the compressor 118. While the illustrated implementation utilizes a turbocharger to increase the intake manifold pressure, other methods of compression can be used, for example an electric or engine powered compressor (e.g., supercharger).

Figure 2:
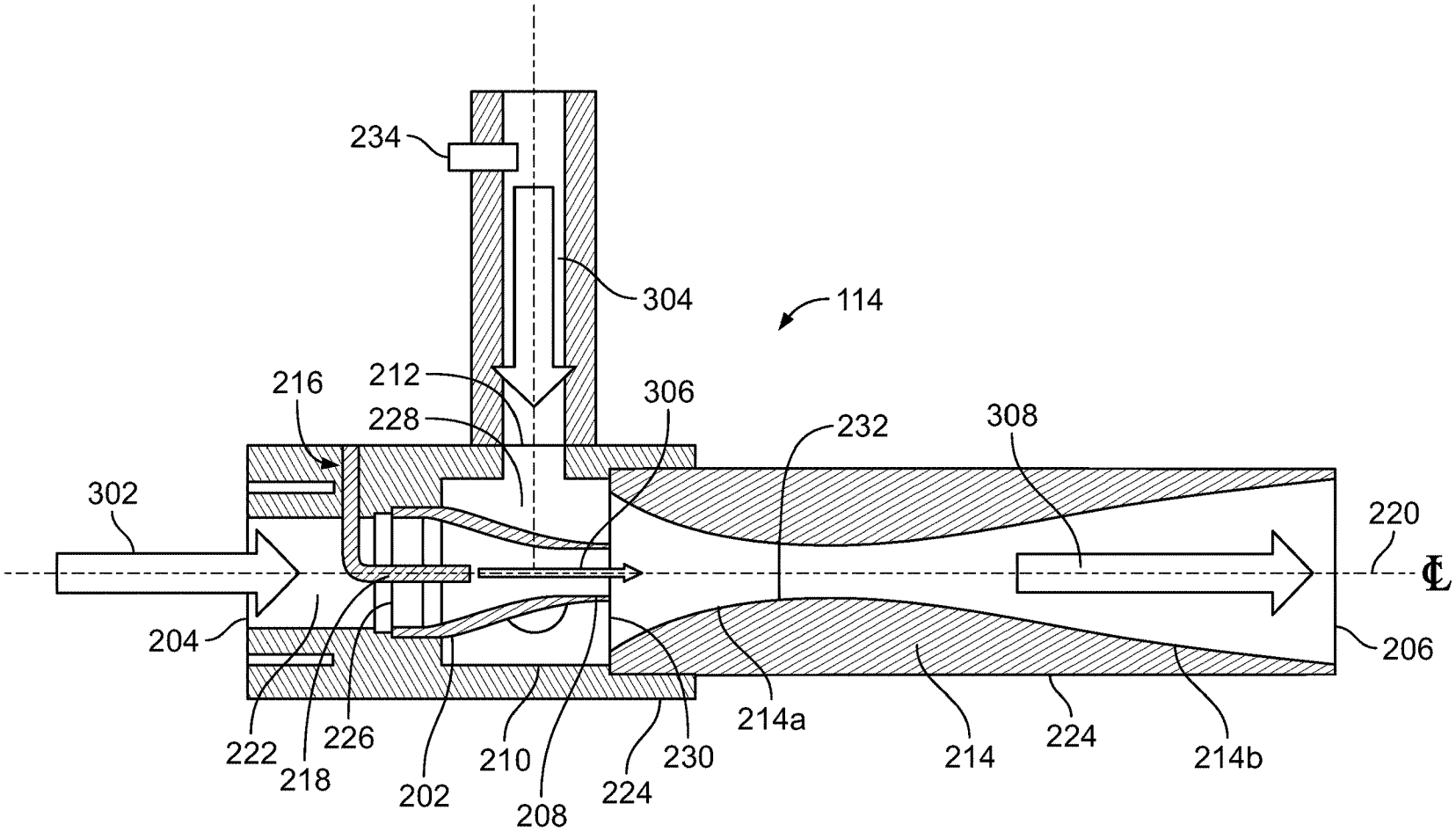
FIG. 2 is a half cross-sectional view schematic diagram of an example exhaust gas recirculation mixer.

FIG. 2 is a half cross-sectional schematic diagram of an example EGR mixer 114. The EGR mixer 114 is made up of one or more housings or casings. Openings in the end walls of the casings define an air inlet 204 and an outlet 206 of an interior flow passage 222 defined by casing(s) 224. The interior flow passage 222 directs flow from the air inlet 204 to the outlet 206 to allow flow through the mixer 114. Within the casing(s) 224, the EGR mixer 114 includes a convergent nozzle 202 in a flow path from the air inlet 204 of the mixer 114 and the outlet 206 of the EGR mixer 114. The convergent nozzle 202 converges in the direction of flow toward a convergent end 208. That is, the downstream end (outlet) of the convergent nozzle 202 has a smaller cross-sectional area, i.e., a smaller flow area, than the upstream end (inlet) 226 of the convergent nozzle 202. The EGR mixer 114 includes an exhaust gas receiver housing 210 and the housing 210 includes one or more exhaust gas inlets 212 fed from and fluidically connected to the EGR flow passage 108 and into an interior receiver cavity 228 of the exhaust gas housing 210. In the illustrated implementation, the housing 210 surrounds the convergent nozzle 202, such that a portion of the convergent nozzle 202 is within the interior receiver cavity 228. The convergent nozzle 202 is positioned to form a free jet of gas out of the convergent end 208 of the nozzle 202. Also, the exhaust gas inlet 212 is upstream of an outlet, the convergent end 208, of the convergent nozzle 202. While the illustrated implementation shows the convergent nozzle 202 to be at least partially within the exhaust gas receiver housing 210, other designs can be utilized. In some implementations, the air inlet 204 and the outlet 206 are provided with attachments or fittings to enable connection to the intake manifold 104 of the engine 102 and/or the EGR mixer 114. In some instances, the nozzle 202 can be modularly interchangeable with nozzles 202 of different the inlet area 226 and convergent area 208, making the system readily changeable to fit multiple engine sizes. For example, the nozzle 202 can be provided with threads or another form of removable attachment to the remainder of the mixer casing 224.

A convergent-divergent nozzle 214 is downstream of the convergent end 208 of the convergent nozzle 202 and is fluidically coupled to receive fluid flow from the convergent end 208, the exhaust gas inlet 212, and, in certain instances, a fuel supply 216. In other words, the convergent-divergent nozzle 214 can act as an air-fuel-exhaust gas inlet for the intake manifold 104. To help facilitate mixing, an inlet 230 of the convergent-divergent nozzle 214 has a greater area than an exit of the convergent nozzle 202. The convergent-divergent nozzle includes three parts: the inlet 230, the throat 232, and the outlet 206. The throat 232 is the narrowest point of the convergent-divergent nozzle and is located and fluidically connected downstream of the inlet 230 of the convergent-divergent nozzle. The narrowing of the convergent-divergent nozzle at the throat 232 increases a flow velocity of a fluid flow as it passes through the convergent-divergent nozzle 214. The outlet 206 of the convergent-divergent nozzle is fluidically connected to and upstream of the intake manifold 104. Between the throat 232 and the outlet 206, the cross-section of the flow passage through the convergent-divergent nozzle increases. The increase in cross-sectional area slows the flow velocity and raises the pressure of the fluid flow. In certain instances, the increase in cross-sectional area can be sized to increase a pressure within the mixer 114 so that the pressure drop across the mixer 114 is zero, nominal or otherwise small. The convergent-divergent nozzle 214 can include threads or another form of removable attachment at the inlet 230, the outlet 206, or both to allow the convergent-divergent nozzle 202 to be installed and fluidically connected to the remainder of the intake of the engine system 100. Like, the convergent nozzle 202, the convergent-divergent nozzle 214 can be modularly interchangeable with nozzles 214 of different inlet 230, throat 232 and outlet 206 areas too make the system readily changeable to fit multiple engine sizes.

The illustrated implementation shows the convergent nozzle and the convergent-divergent nozzle aligned at a same center axis 220, but in some implementations, the center axis of the convergent nozzle and the convergent-divergent nozzle might not be aligned or parallel. For example, space constraints may require the EGR mixer to have an angle between the axis of the convergent nozzle and the convergent-divergent nozzle. In some implementations, rather than having a substantially straight flow passage as shown in FIG. 2, the flow passage may be curved.

As illustrated, the fuel supply 216 includes a fuel supply tube 218 terminating parallel and centrally within the air flow path. The fuel supply tube 218 is configured to supply fuel into the air flow path in a direction of flow through the mixer 114, and upstream of the convergent nozzle. In some implementations, the fuel supply tube 218 can be a gaseous fuel supply tube, coupled to a source of gaseous fuel. However, the fuel delivered by the fuel supply tube 218 can include any combustible fluid, such as natural gas, gasoline, or diesel. While shown as a single tube, the fuel supply tube 218 can be configured in other ways, for example as a cross through the flow area of the mixer, as fuel delivery holes along the perimeter of the flow area, or in another manner. While the illustrated implementation shows a fuel supply tube 218 configured to inject fuel upstream of the convergent end 208 of the convergent nozzle 202, fuel can also be added with a fuel supply port 234 upstream of the exhaust gas inlet 212. Such a port can include a gaseous fuel supply port. In some instances, the fuel can be delivered at high velocity, with velocities up to including sonic flow at the fuel tube exit 218, such that a fuel—air jet pump is also created, allowing the fuel to provide additional motive force for the primary air flow into and thru the nozzle. In such a case, the higher the pressure the better, such that a sonic jet can be generated, further enhancing mixing of the fuel and air. This reduces the need for the fuel pressure regulator. Additionally, if the fuel jet is cold via the Joules-Thompson effect, this is favorable as it will cool the air/fuel stream, thus reducing the air path charge air cooler heat removal requirements as well.

The illustrated implementation operates as follows. The convergent nozzle 202 increases a velocity and decreases a pressure of an air flow 302 in the EGR mixer 114. An exhaust flow 304 is drawn into the EGR mixer 114 through the exhaust gas inlet 212 in response to (e.g., because of) the decreased pressure of the free jet air flow 302 exiting the convergent nozzle 202. The exhaust flow 304 is directed from the exhaust manifold 106 eventually to the point downstream of the convergent nozzle 202. The air flow 302, the exhaust flow 304, and a fuel flow 306 are mixed to form a combustion mixture 308 with a second convergent nozzle 214*a* positioned downstream of the convergent nozzle 202. A pressure of the combustion mixture is increased and a velocity of the combustion mixture is reduced with a divergent nozzle 214*b*. While the second convergent nozzle 214*a* and the divergent nozzle 214*b* are illustrated as a single convergent-divergent nozzle 214, the second convergent nozzle 214*a* and the divergent nozzle 214*b* can be separate and distinct parts.

In the illustrated implementation, the fuel flow 306 is supplied into the air flow 302 with a fuel supply tube 218 parallel and in line with a center of an air flow passage. The fuel flow is supplied upstream of the convergent nozzle 202. In some implementations, the fuel flow is supplied into the exhaust flow with a fuel supply port. Regardless of the implementation used, the fuel flow 306 can include a gaseous fuel flow. In some implementations, the fuel flow 306 has an injection velocity higher than an air flow 302 velocity. Such a high velocity can aid in mixing the air flow 302, fuel flow 306, and exhaust flow 304.

While this disclosure contains many specific implementation details, these should not be construed as limitations on the scope of what may be claimed, but rather as descriptions of features specific to particular implementations of particular inventions. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. An exhaust gas recirculation mixer, the mixer comprising:

a convergent nozzle in a flow path from an air inlet of the mixer to an outlet of the mixer, the convergent nozzle converging toward the outlet of the mixer;

an exhaust gas housing comprising an exhaust gas inlet for allowing exhaust gas into an interior of the exhaust gas housing; and a convergent-divergent nozzle comprising an air-fuel-exhaust gas inlet in fluid communication to receive fluid flow from the convergent nozzle; and a fuel supply coupled to the mixer, the fuel supply comprising a fuel supply tube positioned parallel to and centrally within the air flow path, the fuel supply tube configured to supply fuel into the air flow path upstream of the convergent nozzle.

2. The exhaust gas recirculation mixer of claim 1, where the fuel supply tube comprises a gaseous fuel supply tube.

3. The exhaust gas recirculation mixer of claim 1, where the fuel supply comprises a fuel supply port upstream of the exhaust gas inlet.

4. The exhaust gas recirculation mixer of claim 3, where the fuel supply port comprises a gaseous fuel supply port.

5. The exhaust gas recirculation mixer of claim 1, where the convergent nozzle and the convergent-divergent nozzle are aligned on a same center axis.

6. The exhaust gas recirculation mixer of claim 1, where the exhaust inlet is upstream of an outlet of the convergent nozzle.

7. The exhaust gas recirculation mixer of claim 1, where the convergent nozzle is at least partially within the exhaust gas housing.

8. The exhaust gas recirculation mixer of claim 1, where an inlet of the convergent-divergent nozzle has a greater area than an exit of the convergent nozzle.

9. An engine system comprising:

an intake manifold configured to receive a combustible mixture configured to be combusted within a combustion chamber;

a throttle upstream of the intake manifold, the throttle configured to at least partially regulate an air flow into the intake manifold;

an exhaust manifold configured to receive combustion products from the combustion chamber; and an exhaust gas recirculation mixer downstream of the throttle and upstream of an intake manifold, the exhaust gas recirculation mixer comprising:

a convergent nozzle in a flow path from an air inlet of the mixer to an outlet of the mixer, the convergent nozzle converging toward the outlet of the mixer;

an exhaust gas housing comprising an exhaust gas inlet into an interior of the exhaust gas housing;

a convergent-divergent nozzle comprising an air-fuel-exhaust gas inlet in fluid communication to receive fluid flow from the convergent nozzle, the interior of the exhaust gas housing, and a fuel supply into the mixer; and a fuel supply coupled to the mixer, the fuel supply comprising a fuel supply tube positioned parallel to and centrally within the air flow path, the fuel supply tube configured to supply fuel into the air flow path upstream of the convergent nozzle.

10. The engine system of claim 9, further comprising a compressor upstream of the throttle, the compressor configured to increase a pressure within the air flow path.

11. The engine system of claim 10, further comprising a turbine downstream of the exhaust manifold, the turbine being coupled to the compressor and configured to rotate the compressor.

12. The engine system of claim 9, further comprising an exhaust gas cooler positioned within a flow path between the exhaust manifold and the exhaust gas recirculation mixer, the exhaust gas cooler configured to lower a temperature of the exhaust gas prior to the exhaust gas recirculation mixer.

* * * * *